US011096465B2

(12) United States Patent
Stampe et al.

(10) Patent No.: US 11,096,465 B2
(45) Date of Patent: Aug. 24, 2021

(54) HAIR REMOVAL APPARATUS

(71) Applicant: KONINKLIJKE PHILIPS N.V., Eindhoven (NL)

(72) Inventors: Uros Stampe, Eindhoven (NL); Stefan Feichter, Eindhoven (NL); Jianfei Wu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 834 days.

(21) Appl. No.: 14/900,220

(22) PCT Filed: Jun. 19, 2014

(86) PCT No.: PCT/EP2014/062913
§ 371 (c)(1),
(2) Date: Dec. 21, 2015

(87) PCT Pub. No.: WO2014/206852
PCT Pub. Date: Dec. 31, 2014

(65) Prior Publication Data

US 2016/0143410 A1 May 26, 2016

(30) Foreign Application Priority Data

Jun. 28, 2013 (EP) ..... 13174224

(51) Int. Cl.
*B26B 19/46* (2006.01)
*A45D 26/00* (2006.01)
(Continued)

(52) U.S. Cl.
CPC ..... *A45D 26/0033* (2013.01); *A45D 26/00* (2013.01); *A45D 26/0028* (2013.01);
(Continued)

(58) Field of Classification Search
CPC .... A45D 26/0033; A45D 42/10; A45D 27/00; A45D 26/00; A45D 26/0023;
(Continued)

(56) References Cited

U.S. PATENT DOCUMENTS 5,970,616 A * 10/1999 Wahl ..... B26B 19/063 30/199
9,249,948 B2 * 2/2016 Darwinkel ..... B26B 19/46
(Continued)

FOREIGN PATENT DOCUMENTS

CN 200962944 Y 10/2007
DE 965682 C 6/1957
(Continued)

OTHER PUBLICATIONS

Machine Translation: Kapitz WO 2008/077644.*

*Primary Examiner* — Diane D Yabut
*Assistant Examiner* — Christina C Lauer

(57) ABSTRACT

The present invention relates to mechanical hair removal. In order to provide a handheld hair removal apparatus with improved detection of fine hair, a handheld hair removal apparatus (10) is provided that comprises a hair removal arrangement (12), a support structure (14) for supporting the hair removal arrangement, and a light source (16) attached to the support structure. During operation, a main movement direction (20) of the apparatus is provided. The hair removal arrangement comprises a skin contact portion (22) extending at least along a primary axis (24) extending perpendicularly to the main movement direction for contacting a user's skin during operation. Further, the light source can be arranged in an operational position ($P_O$) at a side of the hair removal arrangement in front of the skin contact portion with respect to the main movement direction. Still further, in the operational position the light source provides a light beam (28) with a main propagation axis (30) enclosing an angle of
(Continued)

incidence (32) of less than 30° with an imaginary plane (33) extending parallel to the main movement direction and the primary axis.

24 Claims, 5 Drawing Sheets

(51) Int. Cl.

| | |
|---|---|
| ***A45D 27/00*** | (2006.01) |
| ***F21V 21/00*** | (2006.01) |
| ***F21V 21/26*** | (2006.01) |
| ***F21V 21/32*** | (2006.01) |

(52) U.S. Cl.
CPC ..... *A45D 27/00* (2013.01); *B26B 19/46* (2013.01); *F21V 21/00* (2013.01); *F21V 21/26* (2013.01); *F21V 21/32* (2013.01); *A45D 2026/008* (2013.01)

(58) Field of Classification Search
CPC ..... A45D 26/0038; A45D 26/0066; A45D 26/0076; A45D 2026/008; B26B 19/46; F21V 21/00; F21V 21/26
See application file for complete search history.

(56) References Cited

U.S. PATENT DOCUMENTS

| | | | | |
|---|---|---|---|---|
| 2005/0111214 | A1 | 5/2005 | Zeiler | |
| 2007/0239174 | A1 * | 10/2007 | Yiu | A45D 26/0028 606/133 |

FOREIGN PATENT DOCUMENTS

| | | | | | |
|---|---|---|---|---|---|
| DE | 7217494 | U | | 11/1972 | |
| DE | 102006062365 | A1 | | 6/2008 | |
| DE | 102011000617 | A1 | | 8/2012 | |
| EP | 1623649 | A1 | | 2/2006 | |
| EP | 1657485 | A1 | | 5/2006 | |
| JP | 2007143634 | A | | 6/2007 | |
| WO | WO-9533600 | A1 | * | 12/1995 | B26B 19/38 |
| WO | 0234481 | A1 | | 5/2002 | |
| WO | WO2008077644 | | * | 7/2008 | A45D 26/0066 |
| WO | 2013027136 | A1 | | 2/2013 | |

* cited by examiner

HAIR REMOVAL APPARATUS

This application is the U.S. National Phase application under 35 U.S.C. § 371 of International Application No. PCT/EP2014/062913, filed on Jun. 19, 2014, which claims the benefit of International Application No. 13174224.9 filed on Jun. 28, 2013. These applications are hereby incorporated by reference herein.

FIELD OF THE INVENTION

The present invention relates to mechanical hair removal, and relates in particular to a handheld hair removal apparatus, and to a method of removing hair.

BACKGROUND OF THE INVENTION

It is known to remove hair from parts of the body, for example legs and arms, e.g. for cosmetic or aesthetic reasons, or other reasons. For example, epilation devices or shavers are used to remove hair by mechanical means. Further, also other ways of removing hair exist, for example by applying laser technology, or providing substances onto the skin which attach to the hairs, thus allowing the hairs to be ripped off the skin, for example by waxing technologies. After a hair removal treatment, some hairs may still be left that a user wishes to remove in a further step. However, it has been shown that it may be difficult to detect fine hair, for example after epilating. EP 1 657 485 B1 shows an electrical appliance for personal use in the form of an epilation device, wherein a light source is mounted above an epilation arrangement in order to illuminate the skin portion to be treated by the epilation arrangement. Nevertheless, fine hair may still be present after the epilation procedure.

SUMMARY OF THE INVENTION

There may be a need to improve the detection of fine hair.

The object of the present invention is achieved by the subject-matter of the independent claims, wherein further embodiments are incorporated in the dependent claims. It should be noted that the following aspects of the invention apply also for the handheld hair removal apparatus, and for the method of removing hair.

According to the present invention, a handheld hair removal apparatus is provided that comprises a hair removal arrangement, a support structure, and a light source. The support structure is provided for supporting the hair removal apparatus. The light source is attached to the support structure. During operation, a main movement direction of the apparatus is provided. The hair removal arrangement comprises a skin contact portion extending at least along a primary axis extending perpendicularly to the main movement direction for contacting a user's skin during operation. The light source is arranged in an operational position at a side of the hair removal arrangement in front of the skin contact portion with respect to the main movement direction. In the operational position, the light source provides a light beam with a main propagation axis enclosing an angle of incidence of less than 30° with an imaginary plane extending parallel to the main movement direction and the primary axis.

Advantageously, hair, in particular fine hair, is illuminated from the side, thus providing better contrast between skin and hairs. Thus, improved visibility of the hairs on the skin is provided. Consequently, a user can detect fine hair left after a removal procedure and can thus repeat a hair removal procedure with respect to this particular location. Hence, an optimized result with respect to hair removal can be achieved.

In the operational position, the light beam is provided, relative to the skin, where hair is to be removed, such that hair protruding from the skin is illuminated more strongly than the skin to improve light contrast in order to visually detect hair that still needs to be removed.

In an example, the imaginary plane is extending parallel to the main movement direction, wherein the imaginary plane comprises the primary axis of the skin contact portion, i.e. the skin contact portion is arranged within the imaginary plane.

According to an example, the main propagation axis is transverse to the main movement direction.

For example, the main propagation axis is perpendicular to the main movement direction. The expression "perpendicular" also relates to deviations from the perpendicular arrangement of 90°, e.g. up to +/−5° or +/−10° or +/−15°.

According to an example, in the operational position, the main propagation axis is parallel to the imaginary plane.

For example, the imaginary plane extends parallel to the main movement direction and the primary axis.

According to an example, an angle of divergence of the light beam is 30° or less. For example, the angle of divergence of the light beam is 15° or less.

According to an example, the light source provides a light beam with a fan-shaped cross-section with an angle of divergence of 15° or less.

In an example, the light source is provided as an LED element, for example, as a white SMDLED.

According to an example, the light source is fixedly mounted relative to the support structure.

According to an example, the light source is mounted on a movable carrier that is movable relative to the support structure from a storage position to the operational position.

According to an example, the movable carrier comprises a sliding carrier, wherein the sliding carrier is slideable relative to the support structure in a direction transverse to the skin contact portion to provide an adjustable position of the light source relative to the skin contact portion.

According to a further example, the movable carrier comprises a pivoting carrier, wherein the pivoting carrier is rotatable around an axis extending parallel to the skin contact portion to provide an adjustable position of the light source relative to the skin contact portion.

According to an example, the movable carrier comprises a bendable cord to provide an adjustable position of the light source relative to the skin contact portion.

In a further example, a combination of at least two of the group comprising the sliding carrier, the pivoting carrier, and the bendable cord are provided.

According to an example, the hair removal apparatus is an epilator, and the hair removal component is a rotating epilation cylinder with a number of hair clamping members for catching and clamping hairs and pulling them out of the skin.

According to a further example, the hair removal apparatus is a shaver, and the hair removal component is a shaving head with at least one hair cutting member.

In an example, the shaver is a dry shaver.

In another example, the shaver is a wet shaver.

In a further example, a wet shaver is provided with fixedly mounted (but replaceable), non-moving razor blades for hair removal. For hair removal, the apparatus is manually moved along the skin surface.

According to the invention, also a method of removing hair is provided. The method comprises the following steps:

a) Illuminating a user's skin with a light source of a handheld hair removal apparatus, wherein the light source is attached to a support structure of the hair removal apparatus, which supports a hair removal arrangement, and wherein the light source is arranged in an operational position at a side of the hair removal arrangement in front of a skin contact portion of the hair removal apparatus with respect to a main movement direction of the hair removal apparatus, wherein the skin contact portion extends at least along a primary axis extending perpendicularly to the main movement direction. The light source emits a light beam with a main propagation axis enclosing an angle of incidence of less than 30° with an imaginary plane extending parallel to the main movement direction and the primary axis.

b) Visually detecting hairs present in the light beam.

c) Moving the apparatus in the main movement direction and removing at least a part of the detected hairs.

According to an aspect of the invention, a light source is arranged in the vicinity of a hair removal arrangement within close distance to the hairs that are to be detected. For enhancing the detection of the hairs, the light is provided in such a manner that a light contrast is achieved between the hairs and the skin, wherein the hairs are illuminated more strongly, i.e. the hairs are provided with more light than the skin. Thus, hairs may be detected, for example blond fine hairs, that otherwise would not be visible. The light source is attached to the support structure in order to provide light at an optimized angle of incidence with respect to the skin portion being monitored and from which hair is removed afterwards. The arrangement of the light source can be used not only for epilation devices, but also for shavers, in particular lady shavers.

These and other aspects of the present invention will become apparent from and elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1A:
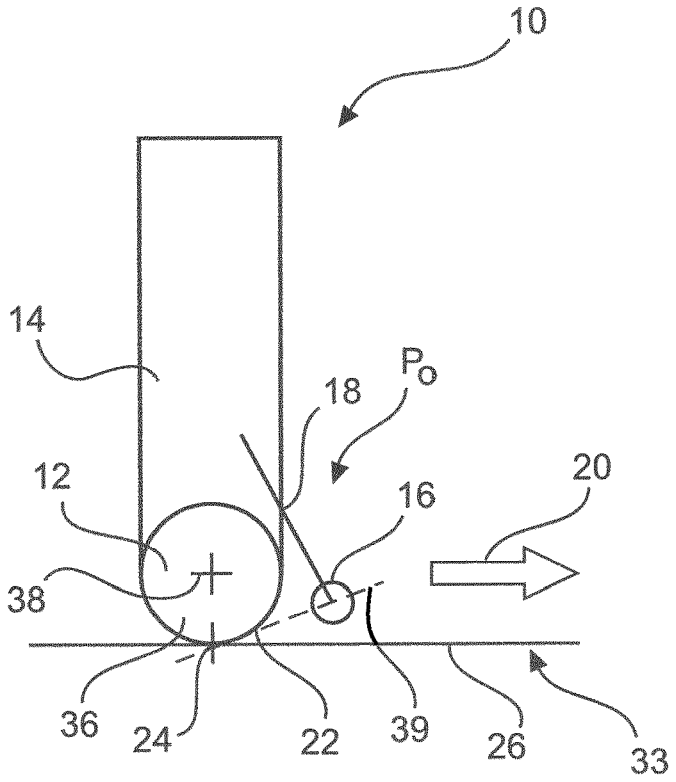
FIG. 1 shows an example of a handheld hair removal apparatus in a side view in FIG. 1A, and in a front view in FIG. 1B.
Figure 1B:
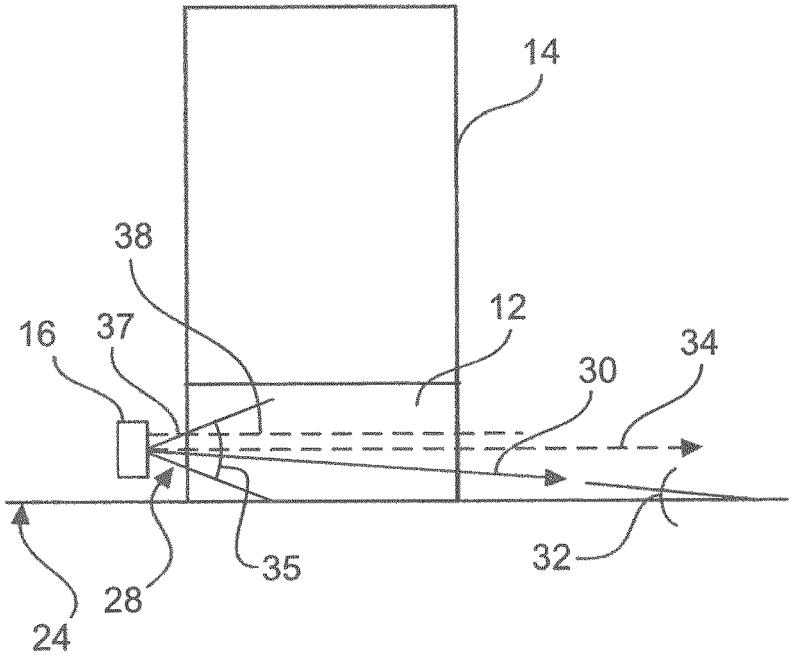

FIG. 1 shows a handheld hair removal apparatus 10 in a side view. The apparatus 10 comprises a hair removal arrangement 12 and a support structure 14 for supporting the hair removal arrangement. Further, a light source 16 is provided that is attached to the support structure by means of attachment line 18, as indicated in the figure. During operation, a main movement direction 20 of the apparatus 10 is provided. The hair removal arrangement 12 comprises a skin contact portion 22 extending at least along a primary axis 24 (see FIG. 1B). The primary axis 24 extends perpendicularly to the main movement direction 20 (i.e. perpendicularly to the image plane of FIG. 1A and hence not further shown) for contacting a user's skin during operation. The user's skin is indicated by means of a reference line 26 in FIG. 1A. The primary axis 24 and the user's skin 26 are shown overlaid in FIG. 1B, wherein the user's skin is simplified to a plane surface although skin usually comprises a rather complex surface with concave and convex portions. The light source 16 can be arranged in an operational position $P_O$ at a side of the hair removal arrangement in front of the skin contact portion 22 with respect to the main movement direction 20. In the operational position, the light source 16 provides a light beam 28 (see FIG. 1B) with a main propagation axis 30 enclosing an angle of incidence 32 of less than 30° with an imaginary plane 33 extending parallel to the main movement direction 20 and the primary axis 24. In FIG. 1A, the imaginary plane 33 is shown aligned with the line indicating the user's skin 26 and hence not shown separately.

The term "hair removal" relates to different ways for removing hair, for example cutting the hair, or pulling the hair out of the skin, for example with the hairs' root portions, i.e. with the root of a hair.

In the case of an epilation procedure, the skin is to be cleared of hairs during operation. In the case of shaving, the skin is to be cleared of hairs protruding from the skin, or sticking out from the skin.

The term "skin contact portion" relates to an outer part of the apparatus that will be brought into contact with the skin during use. In other words, during operation, the skin contact portion touches the skin at least partly. Since skin portions usually have different shapes, the skin contact portion will not contact the complete surface of the skin contact portion, but only a part of said portion. For example, the skin contact portion has a longitudinal extension, e.g. with a part-shell shape, i.e. with a part-cylinder surface. In an example, the skin contact portion is a part of a housing, for example having a smooth portion that can easily glide over the skin without irritating the skin. In another example, the skin contact portion is a part of the hair removal arrangement that contacts the skin. The skin contact portion provides an abutment or contact surface, or touching surface, to facilitate the user's handling of the apparatus during operation, since the contact surface ensures the correct distance to the skin for optimized hair removal, while also taking into consideration the translational movement across the skin when removing hair form a larger surface, for example a portion of an arm or leg.

The term "support structure" relates to a base of the apparatus, which supports or holds the components. The support structure can be a housing providing sufficient support or an internal structure, such as a frame or the like. The support structure may be provided as a body structure, providing a body to which the parts and components are mounted. In an example, the support structure comprises a grip-like portion for a user to hold the apparatus. For example, said grip-like portion is a separate member attached to the support structure. In another example, the grip-like portion is formed by the support structure. In a further example, the grip-like portion is formed by a housing portion attached to the support structure.

In an example, the apparatus comprises an electric supply, such as a battery, for example a rechargeable battery, in the case of a cordless appliance, or a converter in the case of a wire-based electric supply. Further, the apparatus comprises means for removing hairs, which are also described below, that are electrically driven, for example by an electric motor or by electric actuators. Further, the apparatus may comprise a control unit for controlling the hair removal arrangement. Still further, control elements such as switches or buttons are provided for activating the hair removal arrangement and the light source. In an example, the light source is controlled by the control unit. In another example, the light source is controlled individually by a light switch.

For example, the hair removal arrangement is mounted to the support structure.

In an example, the hair removal arrangement is mounted to the support structure in a fixed and permanent manner.

In another example, the hair removal arrangement is mounted to the support structure in a detachable manner, for example to be removable for cleaning purposes.

The term "main movement direction" relates to a line of main movement, i.e. to two opposite movement directions along the movement direction line. The term "main" indicates that also other movement directions are possible, but that one is the preferred one for effective and convenient hair removal. The main movement direction may also be referred to as main movement direction line. In an example, the main movement direction is also defined by the hair removal arrangement, according to which a movement direction is most suitable for removing hair when the hair removal arrangement is moved along the skin in a particular direction (see also below). The main movement direction relates to a way of using the arrangement that is common among users. Of course, other positions of use may be possible, but hair removal apparatuses usually have a main direction and thus also a position of use, so-to-speak, with respect to the user's skin. Hence, an operational spatial arrangement will be achieved by the user as a result of the specific position in which the hair removal apparatus is held. The position may also be referred to as operational position, and can be defined as a position of use in which an optimized hair removal result can be expected.

The expression "a primary axis extending perpendicularly to the main movement direction" also relates to deviations from the perpendicular arrangement, e.g. up to +/−5° or +/−10° or +/−15°.

The light source is attached to the support structure, for example by being mounted to a housing structure that is connected to the support structure. In another example, the light source is attached to a housing portion that is removably attached to the support structure, for example a detachable head portion. The head portion may comprise the hair removal arrangement partly enclosed by a head housing portion, to which the light source is mounted. In another example, the light source is mounted to a housing part or structural part of the hair removal arrangement.

The term "propagation axis" relates to a characterizing line of light emanating from the light source. In an example, the "propagation axis" is the central line of the light emanating from the light source. In another example, the "propagation axis" is the part of the light beam with the highest brightness.

The term "angle of incidence" relates to the angle that is formed by, i.e. the angle between the main propagation axis and the imaginary plane. During use, the imaginary plane may be aligned with the skin, or at least a part of the skin. In an example, during use, the main propagation axis of the light emanating from the light source is hence provided so as to make an angle with the skin of less than 30°.

In an example, the imaginary plane extends only parallel to the main movement direction. In another example, the imaginary plane extends only parallel to the primary axis.

The angle of incidence, or incidence angle, is relevant in particular for the illumination of the hairs in such a way that detection by the user is enhanced. The hairs are best visible if illuminated from the side, while at the same time the background, i.e. the skin, is kept free of illumination by the light source. Hence, in an optimized position, the hairs are shown in the light, while the skin is only illuminated by surrounding light.

The angle of incidence, or incidence angle, is thus relevant in relation to the skin.

The opposite part of the light beam, i.e. light in a direction away from the skin, does not contribute to the detection of the hairs directly. Hence, a radiation angle of the light source, or angle of divergence, can be asymmetric with respect to a line of light from the light source to the area where the hairs are expected.

According to an example, indicated in FIG. 1B as an option, the light source 16 provides a light beam with a main propagation axis that is parallel to the imaginary plane. This parallel main propagation axis is indicated with a dotted arrow 34 in FIG. 1B.

Further, as an option, an angle of divergence 35 of the light beam is 30° or less (not further shown), e.g. 15° or less. In an example, the light beam of the light source 16 has a fan-shaped cross-section 37 with an angle of divergence of 15° or less.

The term "fan-shaped" relates to a shape of the light beam in a cross sectional view along the propagation axis.

In an example (not shown in detail), the light beam is provided with a cone-like shape with an increasing width in the propagation direction. The cone beam may be round in shape, in a cross-section perpendicular to the propagation axis, or oval or ellipsoid.

In another example, the light beam has a fan shape with an increasing width in the propagation direction, wherein the increasing width occurs in a first direction perpendicular to the propagation direction, whereas in a second direction that is perpendicular to the propagation direction and the first direction, the beam has a cross-section area with a uniform width, or with a width that increases only minimally. For example, a slit-like beam having a fan shape along the propagation axis is provided.

In an example, the imaginary plane extends parallel to the main movement direction and the primary axis.

The hair removal arrangement 12 may comprise a hair removal component 36 with a longitudinal axis 38 extending parallel to the primary axis. The main movement direction 20 of the apparatus is transverse, for example perpendicular, to the longitudinal axis 38 of the hair removal component 36.

For example, the hair removal arrangement comprises a rotating epilation element or epilation cylinder with a number of epilation disks with slit openings to catch hairs and pull them out of the skin. The rotating axis is aligned with the longitudinal axis 38. In an example, the epilation cylinder is provided with a number of hair clamping members for catching and clamping hairs and pulling them out of the skin.

For example, the hair removal arrangement comprises a shaving head with at least one hair cutting member. In an example, the shaving head is an elongated head. For example, the shaving head comprises a plurality of upright smear elements (or shear portions) covered by a shaver head foil with a plurality of holes. The shaving head is also referred to as razor head, shear head, or smear head. In an example, the shaving head is moved back and forth in a stepwise manner in the longitudinal direction to cut hairs extending through the holes in the foil. The axis of the razor head is aligned with the longitudinal axis 38 and the translation movement direction.

In an example, the light source is configured to provide parallel illumination such that hairs on the skin are illuminated more strongly than the respective skin surface.

According to a further example, in the operational position $P_O$, the main propagation axis of the light beam and the primary axis of the skin contact portion are situated in a common plane 39 for alignment with the user's skin during operation of the apparatus. It is noted that in FIG. 1*a* the common plane 39 is indicated with a dotted line and shown inclined to the user's skin 26. In an example, the "alignment with the user's skin during operation" relates to arranging the apparatus with respect to the skin such that the common plane is parallel to the skin. In another example, the "alignment with the user's skin" relates to an arrangement where the common plane intersects the plane of the skin at a line that is parallel to the primary axis 24.

For example, the propagation axis and at least one light line of the skin contact portion 22 are situated in a common plane. As an option, the propagation axis may be arranged parallel to the line of the skin contact portion.

According to a further example, the propagation axis of the light beam is arranged parallel to the primary axis.

In a further example, in the operational position $P_O$, the light beam is emitted parallel to the skin from which hair is to be removed, such that hairs protruding from the skin are illuminated more strongly than the skin to improve the light contrast in order to visually detect hairs that still need to be removed.

The "light divergence angle" is also referred to as viewing angle or projection angle. It must not be mistaken for the angle of incidence, i.e. the angle at which the light shines or is projected onto the surface, which is also referred to as illumination angle. For example, the light beam has an angle of maximally 15°.

According to an example, the light source 16 is fixedly mounted relative to the support structure. The light source is thus arranged in the operational position $P_O$.

Figure 2:
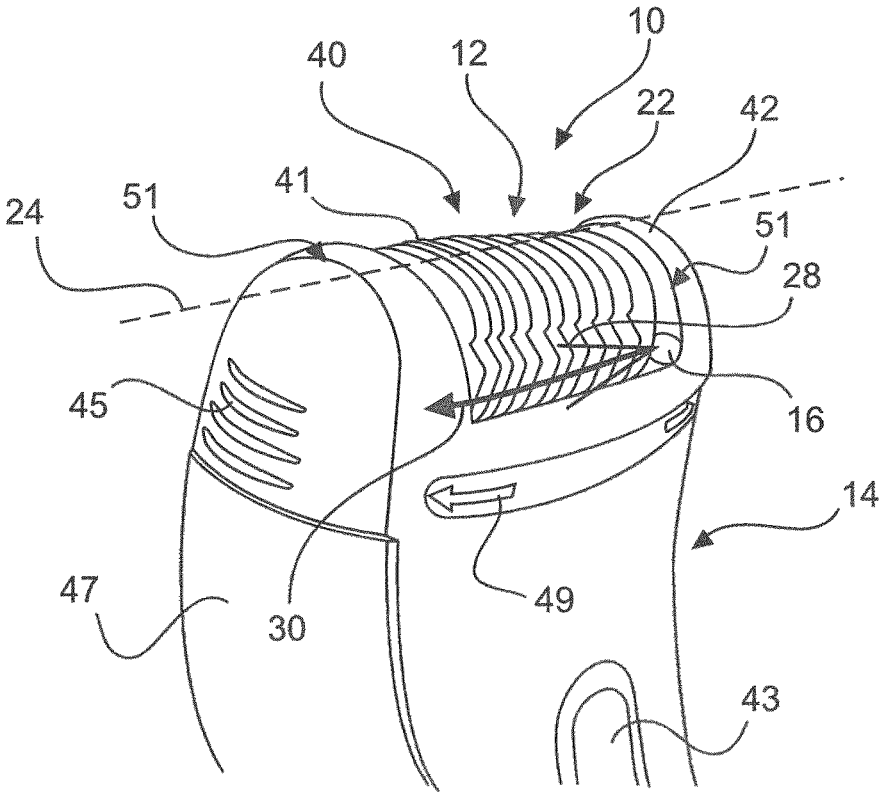
FIG. 2 shows a perspective view of a further example of a handheld hair removal apparatus.

For example, FIG. 2 shows an epilation device 40 as an example of the handheld hair removal apparatus 10, wherein a portion 42 of the epilation front or head part is used for fixedly mounting the light source 16. In an example, the portion 42 is provided as a part of a housing arrangement of the epilation device 40. In another example, the portion 42 is provided as a part of the hair removal arrangement 12.

For example, the light source 16 is provided as an LED element, for example as a white SMDLED.

The epilator comprises an epilation cylinder 41 with a number of hair clamping members for catching and clamping hairs and pulling them out of the skin. A control button 43 is provided for activating the light source 16 and/or for activating the device. Further, a grip portion 45 indicates a removable head portion that can be detached from a base part 47, for example for cleaning purposes. The epilation cylinder 41 has an effective width as indicated with arrows 49, and is arranged between two adjacent side portions 51, one of them acting as the portion 42 to support the light source 16 in FIG. 2, or acting as support for movably mounting the light source 16 in FIG. 3 (see also below).

In a further example, not shown, the light source 16 is fixedly mounted on an appendage or protrusion of a cover or housing of the hair removal apparatus 10.

It must be noted that the examples described for an epilation device are also applicable to a shaver as an example of the handheld hair removal apparatus 10.

Figure 3:
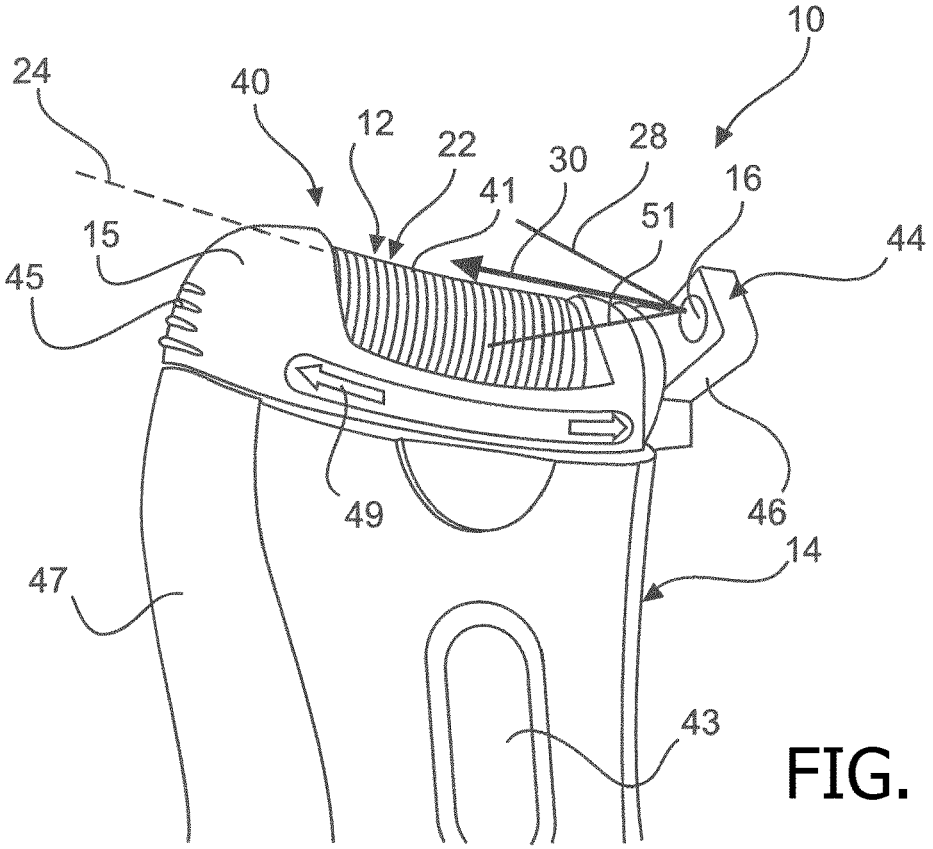
FIG. 3 shows a further example of a handheld hair removal apparatus, which is provided with a slideable light source.

FIG. 3 shows a further example of the handheld hair removal apparatus 10, wherein the light source 16 is mounted on a movable carrier 44 that is movable relative to the support structure from a storage position (not shown in FIG. 3) to the operational position (shown in FIG. 3).

In an example, the movable support is movable between a storage position and the operational position, wherein in the storage position the movable support is integrated into an outer portion of the apparatus. In the operational position, the movable support extends from said outer portion of the apparatus, as indicated in FIG. 3.

The term "shape of the apparatus" relates to a compact form of the apparatus.

The example shown in FIG. 3 shows the movable carrier comprising a sliding carrier 46 that is slideable relative to the support structure in a direction transverse to the skin contact portion to provide an adjustable position of the light source relative to the skin contact portion.

Figure 4:
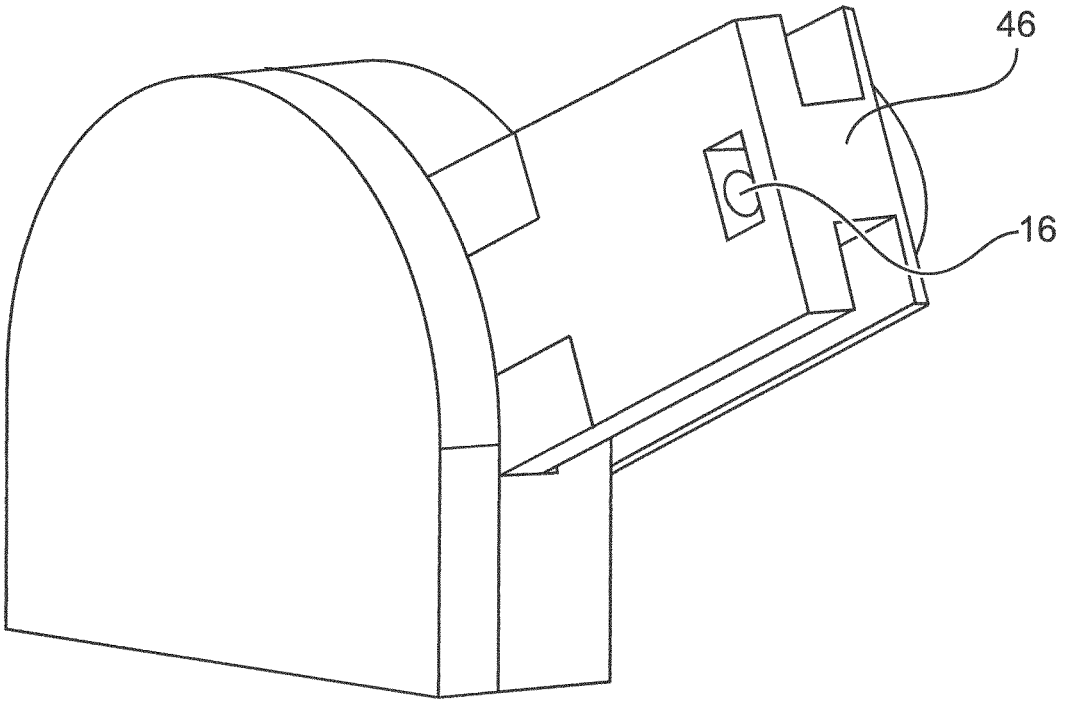
FIG. 4 shows a detailed sectional view of a side portion of a handheld hair removal apparatus with a light source on a slideable carrier.

FIG. 4 shows a further example of the sliding carrier 46 that is provided on side portions of a head area of an epilation device or shaving device.

In a further example, the movable carrier comprises a pivoting carrier 48 that is rotatable around an axis 50 extending parallel to the skin contact portion to provide an adjustable position of the light source relative to the skin contact portion.

Figure 5A:
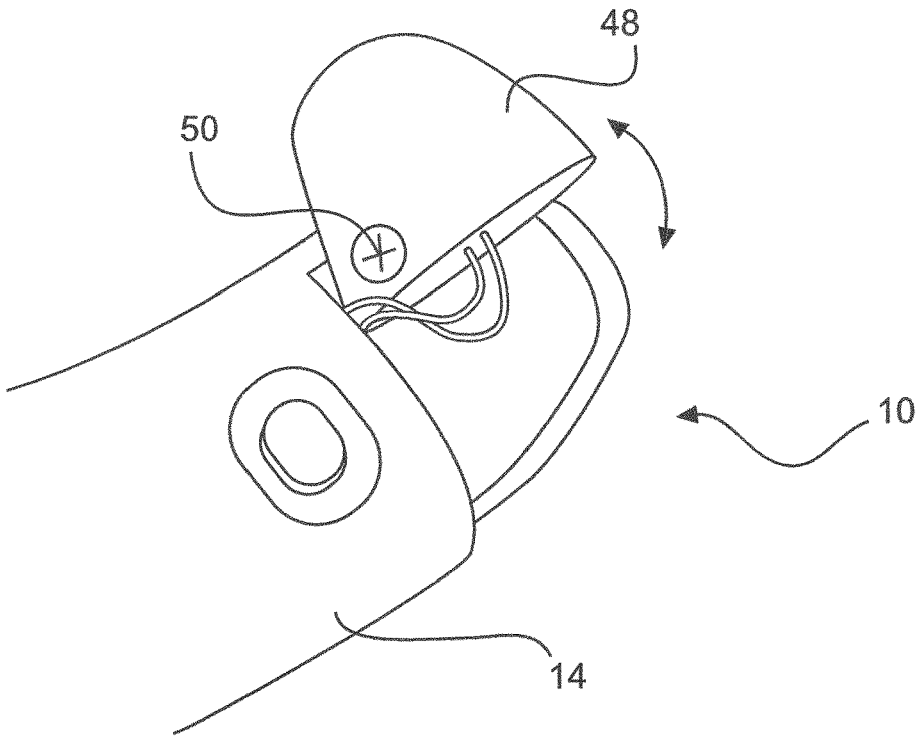
FIG. 5 shows, in FIG. 5A, a first view of a further example of a handheld hair removal apparatus with a light source mounted to a rotatable carrier, and a further view thereof in FIG. 5B.
Figure 5B:
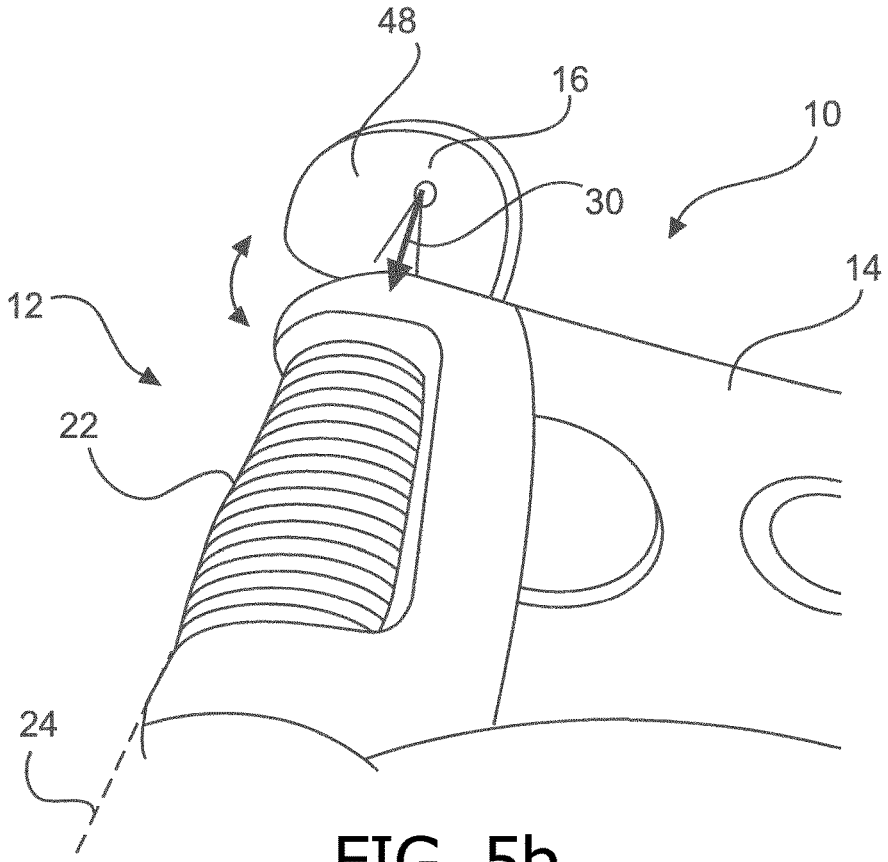

FIG. 5A shows the pivoting carrier 48 arranged on an outer side of a portion on the head of the apparatus. FIG. 5B shows a view from the opposite direction, showing the light source 16 illuminating the skin in front of the apparatus from the side in the above described manner.

Figure 6:
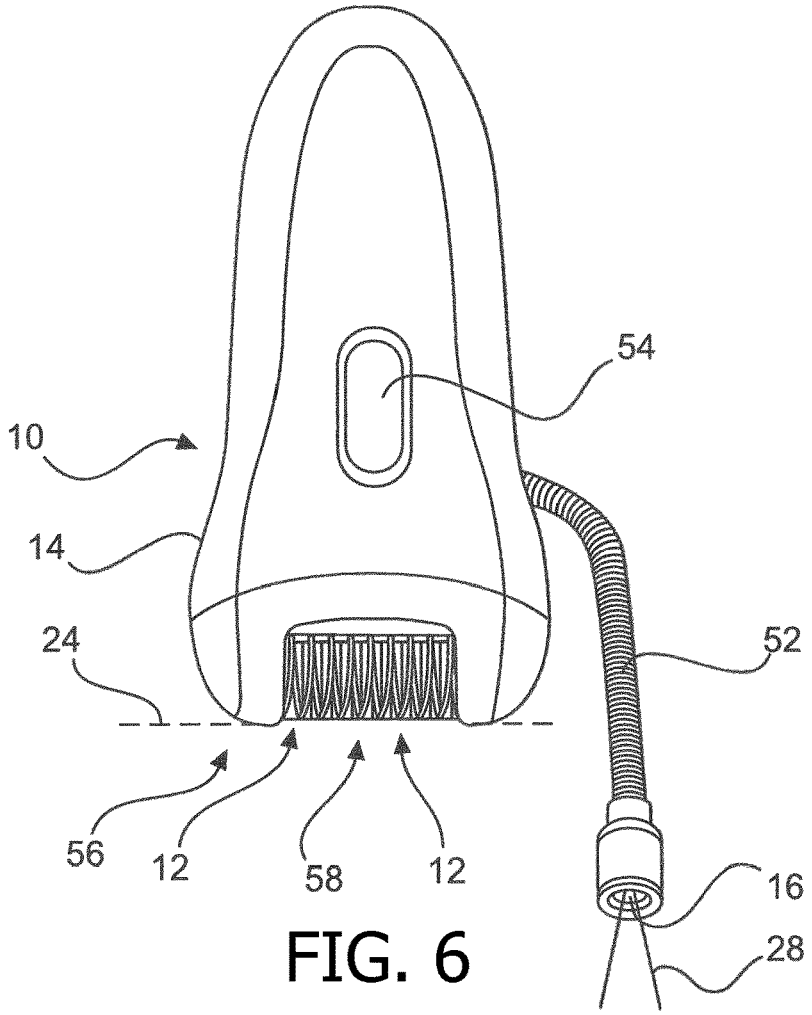
FIG. 6 shows in a front view a handheld hair removal apparatus with a light source mounted to a bendable cord.

FIG. 6 shows the apparatus 10 in a top view. For example, as also indicated, a central operating switch 54 is provided.

As already indicated, the hair removal apparatus 10 is an epilator 56, as shown for example in FIG. 6. The hair removal component is a rotating epilation cylinder 58 with a number of recesses for catching hairs and tweezing them out of the skin. The epilator thus pulls out the hairs.

In a further example, shown in FIG. 6 as a further option, the movable carrier comprises a bendable cord 52 to provide an adjustable position of the light source relative to the skin contact portion. It is noted that in FIG. 6, for illustration purposes only, the bendable cord 52 is arranged such that the light source is pointing in a forward direction. The bendable cord can be formed such that the light source in the operational position $P_O$ is located at a side of the hair removal arrangement and in front of the skin contact portion 22, e.g. the bendable cord is bent slightly more to the right at the root portion, i.e. where it is attached to the support structure or housing, and is then curved to the left to position the light source in the operational position $P_O$, as described above.

In an example, the sliding carrier is arranged next to the skin contact portion, for example at a side of the skin contact portion when referring to the main movement direction. In another example, the pivoting carrier is pivotable in the direction transverse to the skin contact portion. The "pivoting" carrier is also referred to as "rotating" carrier.

The bendable cord 52 is a tube-like structure, for example with a spiral-type tube to allow flexible bending such that the achieved position is maintained. The bendable cord is also known as flex arm or flexible lamp arm. It must be noted that for a handheld hair removal apparatus, the bendable cord is scaled to the respective requirements, i.e. made light and small.

According to an embodiment not further shown here, the hair removal apparatus is a shaver, and the hair removal component is an elongated shaver head with a plurality of shear elements projecting in a direction transverse to a movement direction of the shear elements. The shaver cuts the hairs by shaving or trimming. Shaving relates to the cutting of hairs by a shearing movement of a shear element. Shaving relates to cutting off hairs directly at the outer surface portion of the skin. Trimming relates to cutting hairs with two blades. Trimming relates to cutting off hairs at a distance from the outer surface portion of the skin.

Further, a separate light switch may be provided in case the light is not wanted during use. In a further example, the light is automatically switched on when the hair removal arrangement is activated.

In a further example, the light source is adaptable in terms of brightness and colour, for example for adapting to specific hair and skin colour of a user, or for adapting to room illumination.

In a still further example, the light source is adapted to provide stroboscopic light. For example, the frequency of the stroboscopic light is aligned with the speed, e.g. the rotational speed, of a moving hair removal component.

Figure 7:
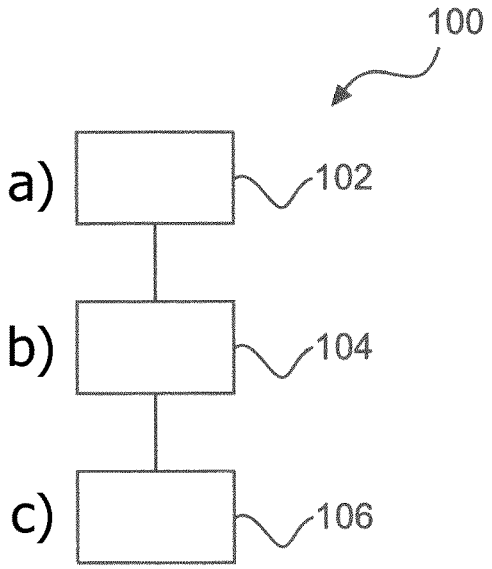
FIG. 7 shows basic steps of an example of a method of removing hair.

FIG. 7 shows a method 100 for removing hair, comprising the following steps:

In a first step 102, a user's skin is illuminated by means of a light source of a handheld hair removal apparatus. The light source is attached to a support structure of the hair removal apparatus that supports a hair removal arrangement. The light source is arranged in an operational position at a side of the hair removal arrangement in front of a skin contact portion of the hair removal apparatus with respect to a main movement direction of the hair removal apparatus. The skin contact portion extends at least along a primary axis extending perpendicularly to the main movement direction, and the light source provides a light beam with a main propagation axis enclosing an angle of incidence of less than 30° with an imaginary plane extending parallel to the main movement direction and the primary axis.

In a second step 104, hairs that are present in the light beam are visually detected.

In a third step 106, the apparatus is moved in the main movement direction and at least part of the detected hairs are removed.

The first step 102 is also referred to as step a), the second step 104 as step b), and the third step 106 as step c).

According to an example, not further shown, in the first illumination step 102, the main propagation axis is provided parallel to the imaginary plane such that hairs protruding from the skin are illuminated more strongly than the skin to improve the light contrast between hairs and skin. In an example, the light source illuminates the skin in a direction parallel to its surface at least in the region of the skin where hairs are to be detected.

It has to be noted that embodiments of the invention are described with reference to different subject matters. In particular, some embodiments are described with reference to method-type claims, whereas other embodiments are described with reference to device-type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A handheld hair removal apparatus, comprising:

a hair removal arrangement having a first lateral side and a second lateral side, the arrangement comprising a hair removal component having a longitudinal axis, wherein a main movement direction of the apparatus in which the arrangement is moved during operation is perpendicular to the longitudinal axis of the hair removal component, wherein the first and second lateral sides are perpendicular to both the main movement direction of the apparatus and the longitudinal axis of the hair removal component;

a support structure for supporting the hair removal arrangement;

wherein the hair removal arrangement is mounted to the support structure in a detachable manner; and a light source attached to the support structure, the light source providing a light beam propogated from the light source from the first lateral side towards the second lateral side of the hair removal arrangement;

wherein the light source provides a light beam with a main propagation axis enclosing an angle of incidence of less than 30° with an imaginary plane extending parallel to the main movement direction and the primary axis;

wherein the hair removal arrangement comprises a skin contact portion extending at least along a primary axis extending perpendicularly to the main movement direction for contacting the user's skin during operation;

wherein, the light source is fixedly mounted to a central region of the support structure by means of a rigid fixed length attachment line, the attachment line being fixedly positioned relative to the support structure, said fixed mounting being located at said first lateral side of the hair removal arrangement in front of the skin contact portion with respect to the main movement direction, and wherein the attachment line is fixedly attached to the light source at a first distal end of the attachment line, and a proximal end of the attachment line is fixedly attached to a first lateral side of the support structure.

2. The apparatus according to claim 1, wherein the main propagation axis is perpendicular to the main movement direction.

3. The apparatus according to claim 1, wherein an angle of divergence of the light beam is 30° or less.

4. The apparatus according to claim 1, wherein the light beam has a fan-shaped cross-section with an angle of divergence of 15° or less.

5. The apparatus according to claim 1, wherein the hair removal arrangement comprises a hair removal component with a longitudinal axis extending parallel to the primary axis; and wherein the main movement direction is transverse to the longitudinal axis of the hair removal component.

6. The apparatus according to claim 1, wherein the main propagation axis of the light beam and the primary axis of the skin contact portion are situated in a common plane for alignment with the user's skin during operation of the apparatus, wherein the common plane is parallel to the skin, wherein the common plane intersects the plane of the skin at a line that is parallel to the primary axis.

7. The apparatus according to claim 1, wherein the main propagation axis of the light beam is arranged parallel to the primary axis.

8. The apparatus according to claim 1, wherein the hair removal apparatus is an epilator; and wherein the hair removal component is a rotating epilation cylinder with a number of hair clamping members for catching and clamping hairs and pulling them out of the skin.

9. The apparatus according to claim 1, wherein the hair removal apparatus is a shaver; and wherein the hair removal component is a shaving head with at least one hair cutting member.

10. The apparatus according to claim 1, wherein an angle between the main propagation axis and the main movement direction is 90°+/−15°.

11. The apparatus according to claim 1, wherein the light source is configured to provide parallel illumination such that hairs on the skin are illuminated more strongly than the respective skin surface.

12. The apparatus according to claim 1, wherein, the light source provides a light beam with a main propagation axis, wherein an angle between the main propagation axis and an imaginary plane extending parallel to the main movement direction and the primary axis is less than 30°.

13. The apparatus according to claim 12, wherein the main propagation axis is parallel to the imaginary plane.

14. The apparatus according to claim 1, wherein the light source is attached to a detachable head portion of the apparatus.

15. A method of removing hair by a handheld hair removal apparatus, the method comprising:

a) illuminating a user's skin by means of a light source of the handheld hair removal apparatus, including a hair removal arrangement comprising a hair removal component having a longitudinal axis, wherein a main movement direction of the apparatus in which the arrangement is moved during operation is perpendicular to the longitudinal axis of the hair removal component, the hair removal arrangement having a first and second lateral side, wherein the light source is propagated from the light source on said first lateral side towards the second lateral side, and wherein a plane of the first and second lateral sides are perpendicular to the main movement direction of the apparatus and the longitudinal axis of the hair removal component, wherein the light source is attached to a support structure of the hair removal apparatus which supports the hair removal arrangement, wherein the hair removal arrangement is mounted to the support structure in a detachable manner, wherein the light source is fixedly mounted to a central region of the support structure by means of a rigid attachment line having a fixed linear length, the attachment line being fixedly positioned relative to the support structure, said mounting being at said first lateral side of the hair removal arrangement in front of the skin contact portion with respect to the main movement direction, and wherein the light source provides a light beam propagatetd from the light source from the first lateral side towards the second lateral side of the hair removal arrangement, wherein the skin contact portion extends at least along a primary axis extending perpendicularly to the main movement direction, and wherein the light source provides a light beam with a main propagation axis, wherein an angle between the main propagation axis and an imaginary plane extending parallel to the main movement direction and the primary axis is less than 30';

b) visually detecting hairs present in the light beam; and c) moving the apparatus in the main movement direction and removing at least part of the detected hairs.

16. The method according to claim 15, wherein in step a), the main propagation axis is parallel to the imaginary plane such that hairs protruding from the skin are illuminated more strongly than the skin to improve the light contrast between hairs and skin.

17. The method according to claim 15, wherein the main propagation axis of the light beam and the primary axis of the skin contact portion are situated in a common plane, wherein the common plane is parallel to the skin, and wherein the common plane intersects the plane of the skin at a line that is parallel to the primary axis.

18. The method according to claim 17, wherein an angle between the main propagation axis and the main movement direction is 90°+/−15°.

19. The method according to claim 17, wherein the light source is configured to provide parallel illumination such that hairs on the skin are illuminated more strongly than the respective skin surface.

20. A handheld hair removal apparatus, comprising:

a hair removal arrangement having a first lateral side portion and a second lateral side portion, the hair removal arrangement comprising a hair removal component having a longitudinal axis arranged between the first lateral side portion and the second lateral side portion, wherein the first and second lateral side portions are perpendicular to both the main movement direction of the hair removal apparatus and the longitudinal axis of the hair removal component;

wherein the hair removal arrangement comprises a skin contact portion extending at least along a primary axis extending perpendicularly to the main movement direction for contacting the user's skin during operation;

a support structure for supporting the hair removal arrangement; and a light source attached to the hair removal arrangement, the light source mounted on a movable carrier that is movable relative to the support structure from a storage position to an operational position, said mounting being at said second lateral side of the hair removal arrangement in front of the skin contact portion with respect to the main movement direction, wherein in the storage position, the movable support is integrated into an outer portion of the apparatus, wherein the outer portion extends beyond the second lateral side portion, wherein in the operational position, the movable support extends from the outer portion of the apparatus;

wherein the movable carrier comprises a sliding carrier, wherein the sliding carrier is slideable relative to the support structure via rotation in a direction transverse to the skin contact portion to provide an adjustable position of the light source relative to the skin contact portion.

21. The apparatus according to claim 20, wherein, in an operational position, the light source provides a light beam with a main propagation axis enclosing an angle of incidence of less than 30° with an imaginary plane extending parallel to the main movement direction and the primary axis.

22. The apparatus according to claim 20, wherein the hair removal arrangement comprises a skin contact portion extending at least along a primary axis extending perpendicularly to the main movement direction for contacting the user's skin during operation.

23. The apparatus according to claim 20, wherein the light source provides a light beam propagated from the light source from the first lateral of the hair removal arrangement side towards the second lateral side of the hair removal arrangement.

24. A handheld hair removal apparatus, comprising:

a hair removal arrangement having a first lateral side and a second lateral side, the arrangement comprising a hair removal component having a longitudinal axis, wherein a main movement direction of the apparatus in which the arrangement is moved during operation is perpendicular to the longitudinal axis of the hair removal component, wherein the first and second lateral sides are perpendicular to both the main movement direction of the apparatus and the longitudinal axis of the hair removal component;

a support structure for supporting the hair removal arrangement; and a light source attached to the support structure, the light source providing a light beam propogated from the light source from the first lateral side towards the second lateral side of the hair removal arrangement;

wherein the hair removal arrangement comprises a skin contact portion extending at least along a primary axis extending perpendicularly to the main movement direction for contacting the user's skin during operation;

wherein, in the operational position ($P_O$), the light source is mounted on a movable carrier that is movable relative to the support structure from a storage position to the operational position, said mounting being at said second lateral side of the hair removal arrangement in front of the skin contact portion with respect to the main movement direction, wherein the movable carrier comprises a pivoting carrier, wherein the pivoting carrier is fixedly rotatable around an axis extending parallel to the skin contact portion to provide an adjustable position of the light source relative to the skin contact portion;

wherein, in the storage position the movable support is integrated into an outer portion of the apparatus, and wherein, in the operational position, the movable support extends from an outer portion of the apparatus.

* * * * *